US007238073B2

(12) United States Patent
Hendrickson

(10) Patent No.: US 7,238,073 B2
(45) Date of Patent: Jul. 3, 2007

(54) INFLATABLE TOWABLE FLOAT

(75) Inventor: Kyle J. Hendrickson, Redmond, WA (US)

(73) Assignee: HO Sports Company, Inc., Redmond, WA (US)

( * ) Notice: Subject to any disclaimer, the term of this patent is extended or adjusted under 35 U.S.C. 154(b) by 0 days.

(21) Appl. No.: 10/882,080

(22) Filed: Jun. 30, 2004

(65) Prior Publication Data

US 2006/0003646 A1 Jan. 5, 2006

(51) Int. Cl.
*B63B 35/74* (2006.01)
*B63B 7/08* (2006.01)

(52) U.S. Cl. ..... 441/66; 441/67; 441/129; 114/345

(58) Field of Classification Search ..... 114/266, 114/267, 253, 61.1, 123, 264, 265, 283, 61.25, 114/345; 441/40–42, 44, 65–67, 125–132; D12/304; 440/26–31; 472/129
See application file for complete search history.

(56) References Cited

U.S. PATENT DOCUMENTS 1,567,555 A * 12/1925 Straussler ..... 441/130
1,639,607 A * 8/1927 Henry ..... 472/129
2,404,729 A * 7/1946 Hurt ..... 472/129
2,814,057 A * 11/1957 Burns ..... 441/35
2,997,299 A * 8/1961 Wilkins, Jr. ..... 472/129
3,204,261 A * 9/1965 Gerehime, Jr. ..... 114/354
3,212,109 A * 10/1965 Roman ..... 114/352
3,605,148 A * 9/1971 Tailer ..... 441/41
D228,258 S * 8/1973 McClure ..... D12/316
3,788,256 A * 1/1974 Bashaw ..... 114/39.28
4,072,124 A * 2/1978 Meyrin ..... 440/27
5,360,360 A 11/1994 Peterson
5,503,099 A 4/1996 Peterson
5,702,278 A 12/1997 Boucher
5,713,773 A 2/1998 Churchill
6,010,381 A 1/2000 Peterson
6,010,382 A 1/2000 Kennedy
6,217,401 B1 4/2001 Peterson
6,220,908 B1 4/2001 Peterson
6,283,811 B1 9/2001 Peterson
6,386,932 B1 5/2002 Murphy
6,394,019 B1 5/2002 West
6,582,264 B2 * 6/2003 Brown ..... 441/40
D502,240 S * 2/2005 Hendrickson ..... D21/769
7,150,699 B2 * 12/2006 Yang ..... 482/27

(Continued)

FOREIGN PATENT DOCUMENTS

FR 2121948 8/1972

(Continued)

*Primary Examiner*—Ajay Vasudeva
(74) *Attorney, Agent, or Firm*—George C. Rondeau, Jr.; Davis Wright Tremaine LLP

(57) ABSTRACT

A towable structure is configured to be towed behind a boat while floating above the surface of a body of water. In one implementation, the towable structure has a platform for supporting one or more passengers thereon extending between or otherwise supported by at least three water engaging base members. The base members are buoyant to extend above the surface of the body of water. The platform extends from a location sufficiently elevated on each of the base members so that the platform stays out of the water under normal operation when unloaded and when supporting one or more passengers.

16 Claims, 14 Drawing Sheets

U.S. PATENT DOCUMENTS

2005/0079955 A1* 4/2005 Yang ..... 482/27

FOREIGN PATENT DOCUMENTS

| | | | |
|---|---|---|---|
| FR | 2830233 | | 4/2003 |
| GB | 871 057 | | 6/1971 |
| JP | 60240596 | A * | 11/1985 |
| JP | 06312690 | A * | 11/1994 |
| JP | 10152093 | A * | 6/1998 |
| WO | WO 00/66419 | | 11/2000 |

* cited by examiner

INFLATABLE TOWABLE FLOAT

BACKGROUND OF THE INVENTION

1. Field of the Invention

The present invention is directed generally to structures that float in water and, more particularly, to inflatable structures that can be towed by boat and support a passenger.

2. Description of the Related Art

Floatable structures include those that can be inflated and towed by boat while supporting a passenger. In general, a towed structure being towed by a tow boat imparts drag force to the tow boat due to the towed structure being pulled through water. Consequently, the conventional towed structure may be significantly limited in size to keep drag force to a reasonable level. Unfortunately, both size limitations and unreasonable levels of drag forces can detrimentally impact usefulness of the conventional towed structures.

BRIEF SUMMARY OF THE INVENTION

The present invention resides in a structure to be towed in a body of water. Aspects include a first member having an upper surface and a lower surface. At least three spaced apart buoyant second members extend from the first member and have sufficient buoyancy such that when the second members are placed in the body of water, the first member remains elevated above the body of water to define an air space between the lower surface of the first member and the body of water when the body of water has a level water surface.

Other features and advantages of the invention will become apparent from the following detailed description, taken in conjunction with the accompanying drawings.

BRIEF DESCRIPTION OF THE SEVERAL VIEWS OF THE DRAWING(S)

DETAILED DESCRIPTION OF THE INVENTION

As will be discussed in greater detail herein, a towable structure is configured to be towed behind a boat while floating above the surface of a body of water. In one implementation, the towable structure has a platform for supporting one or more passengers thereon extending between or otherwise supported by at least three water engaging base members. The base members are buoyant to extend above the surface of the body of water. The platform extends from a location sufficiently elevated on each of the base members so that the platform stays out of the water under normal operation when unloaded and when supporting one or more passengers. The total combined surface area of those portions of the base members in contact with the body of water is typically much less than that portion of the surface area of the platform that would contact the body of water if not supported by the base members. Consequently, the towable structure may impart less drag force on the tow boat than a conventional towable structure for an equivalent amount of surface area available to support passengers or objects being carried by the towable structure.

Figure 1:
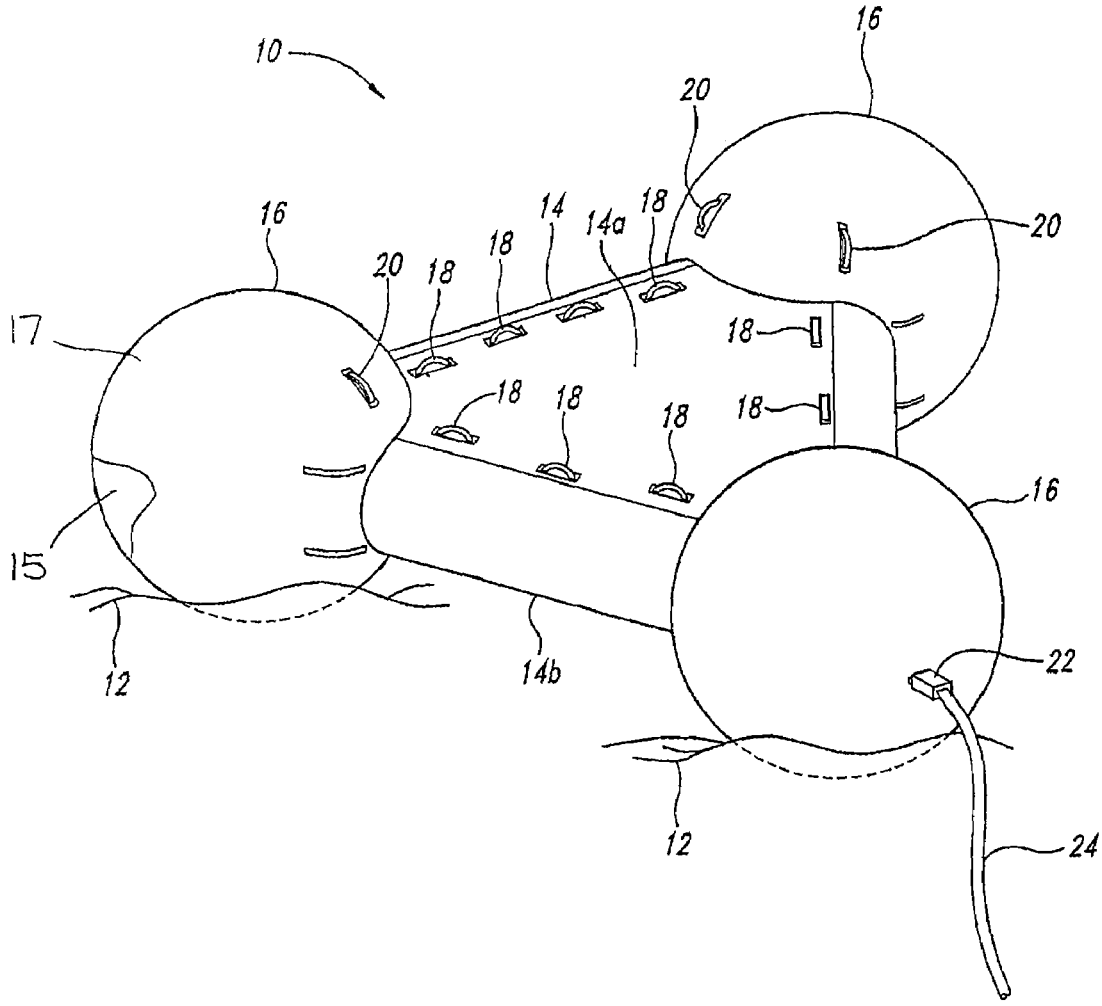
FIG. 1 is a front isometric view of a first towable structure according to aspects of the present invention.

A first towable structure 10 implemented according to aspects of the present invention to float in a body of water 12 is depicted in FIG. 1 as having a platform 14 having a upper surface 14*a* for supporting passengers and objects (not shown) and a lower surface 14*b* facing the body of water. The platform 14 of the first towable structure 10 approximates a general triangular shape (better shown in FIG. 2) having corners that are coupled to three base members 16. The platform 14 extends between the three base members 16 so as to be elevated above the body of water 12 under normal operating conditions. The three base members 16 are spaced apart from each other and attached to the platform 14 to hold the platform raised above the water to define an air space between the lower surface 14*b* and the water, and support one or more passengers in an elevated position above the water. As such, the passengers are positioned on the platform 14 spanning between the water engaging base members 16 without the platform engaging the water. The lower surface 14*b* of the platform 14 is preferably held by the base members 16 at least two inches above the water when unloaded without being pulled, and also when loaded with a passenger when being pulled by a tow boat, so as to carry the passenger above and out of the water and without the lower surface 14*b* dragging in the water.

The platform 14 and the base members 16 are formed by separately inflatable bladders or can be molded as a single bladder. The first towable structure 10 may also be implemented with one or more components being non-inflatable such as with foam. In a particular implementation, the first towable structure 10 is made of inflatable bladders 15 that are inserted into a shell 17 (such as made from a nylon material) being formed to take on the shape of the first towable structure.

Figure 2:
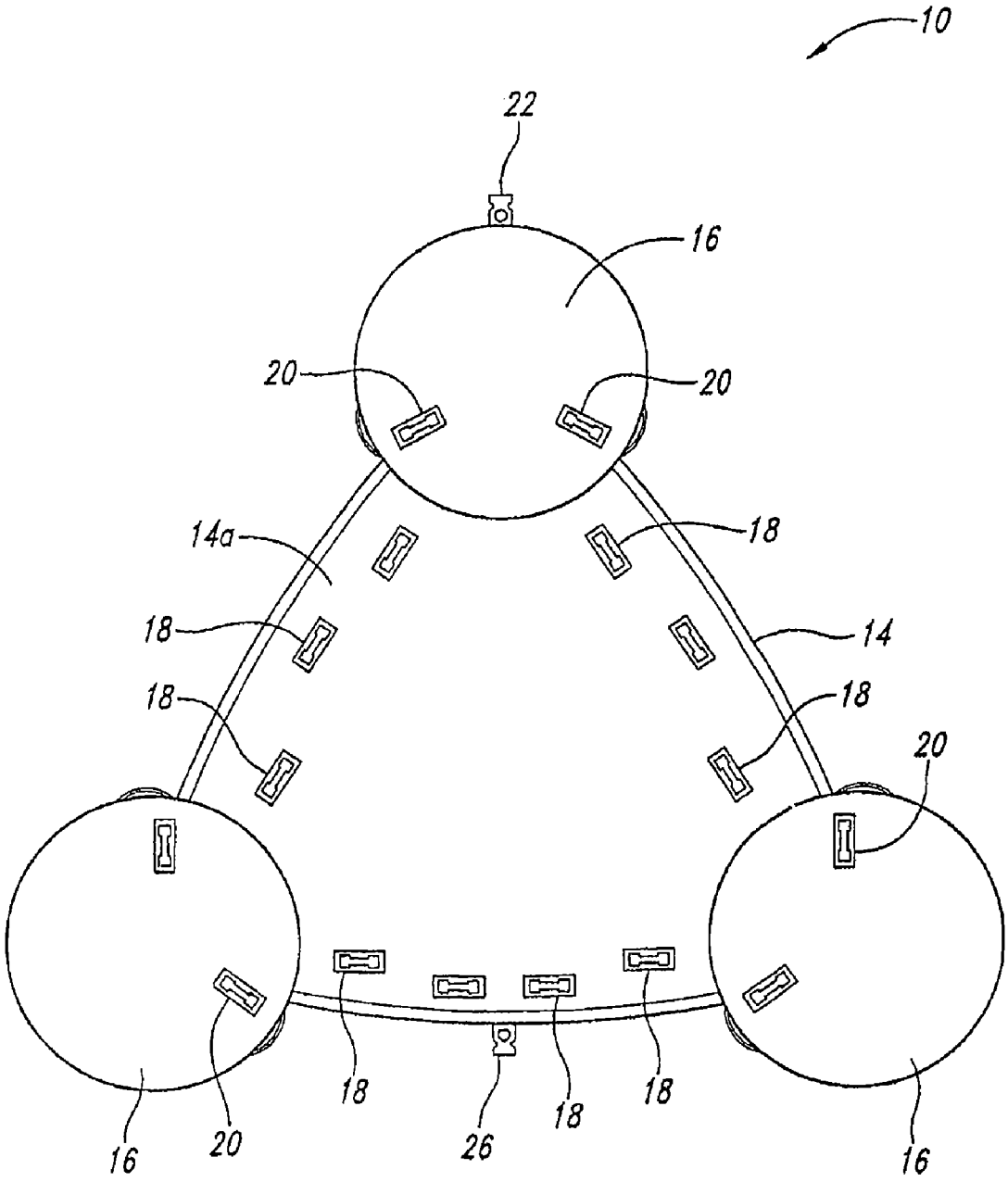
FIG. 2 is a top plan view of the first towable structure of FIG. 1.

The base members 16 are depicted for the first towable structure as each approximating a general spherical shape. The platform 14 includes handles 18 and the base members 16 also include handles 20 to provide grip support for passengers of the first towable structure 10. At least one of the base members 16 has an attachment point 22 to receive a rope, cable, or other flexible member 24 used to tow the first towable structure by a boat (not shown). As shown in FIG. 2, the platform 14 has at least one attachment point 26, which can also be used for securing a flexible member 24 (such as a rope, cable, or other flexible member (not shown)) to the first towable structure to be towed by a tow boat as an alternative to the attachment point 22 described above.

Figure 3:
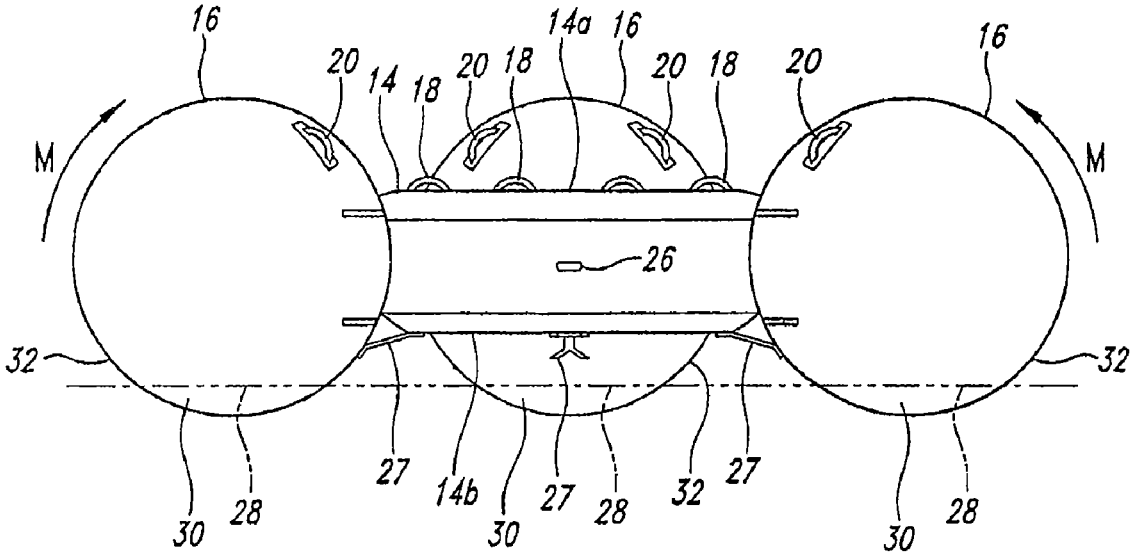
FIG. 3 is a rear elevational view of the first towable structure FIG. 1.

As shown in FIG. 3, to provide additional stability to the platform 14, at least one flexible strut or support member 27 is coupled to each of the base members 16 and to the lower surface 14*b* of the platform in such a way to counteract moment forces M to prevent the base members from rotating upward about the platform and to prevent the platform from being lowered with respect to the base members. This provides rigidity to the front towable structure 10. The support members 27 can be made of a fabric including a webbing material as long as the material is sufficiently strong with regard to the moment forces M.

In a depicted exemplary implementation with the body of water 12 having no waves or other movement as shown in FIG. 3, the body of water would have a level water surface 28. When the first towable structure 10 is in an unloaded state not carrying passengers and/or objects with the body of water 12 in the still condition, each of the base members 16 extend below the level water surface 28 to a certain amount with a submerged portion 30 of the base member being below the level water surface and an unsubmerged portion 32 of the base member being above the level water surface.

In the exemplary implementation, the first towable structure weighs approximately 62.4 pounds thereby displacing approximately a cubic foot of the body of water 12. With the three base members 16 each approximating a spheroid with a diameter of 3.5 feet, each of the three base members would be submerged into the body of water 12 a vertical amount of approximately 3 inches thereby each displacing approximately a third of a cubic foot of water a piece and having surface contact with the body of water over approximately 2.75 square feet of each. The three base members 16 thus present a total of 8.25 square feet of surface contact with the body of water 12. In the exemplary implementation, the upper surface 14*a* of the platform 14 is sized to have approximately 26.4 square feet of surface area. Consequently, in this implementation the surface area of contact for the three base members with the body of water 12 is 31% of the surface area of the upper surface 14*a* of the platform 14, which could beneficially reduce the amount of drag force experienced by the first towable structure 10 compared with a towable structure having a surface area equal to the surface area of the upper surface 14*a* of the platform 14 contacting the water. Other implementations have a surface area of contact for three or another number of base members greater than three with the body of water include a ratio of over 31% such as no more than 40% or no more than 50% of the surface area of the upper surface 14*a* of the platform 14 or some other upper surface of another shaped body supporting passengers and/or objects.

When loaded within its design range for proper operation, with one or more passengers, the base members 16 displace more water and sit lower in the water, but not so much as to allow the lower surface 14*b* of the platform 14 to significantly drag in the water and thus the first towable structure 10 experiences less drag than would be experienced by the platform 14 if fully contacting the water. The lower surface 14*b* of the platform 14 is held above the water surface 28 to define the air space between the water and the lower surface 14*b*, above which the passengers are positioned on the upper surface 14*a* of the platform 14. It is to be understood that a passenger riding on the platform 14 may allow a portion of his or her body to extend outward beyond the upper surface 14*a* and to even touch the water if desired.

Figure 4:
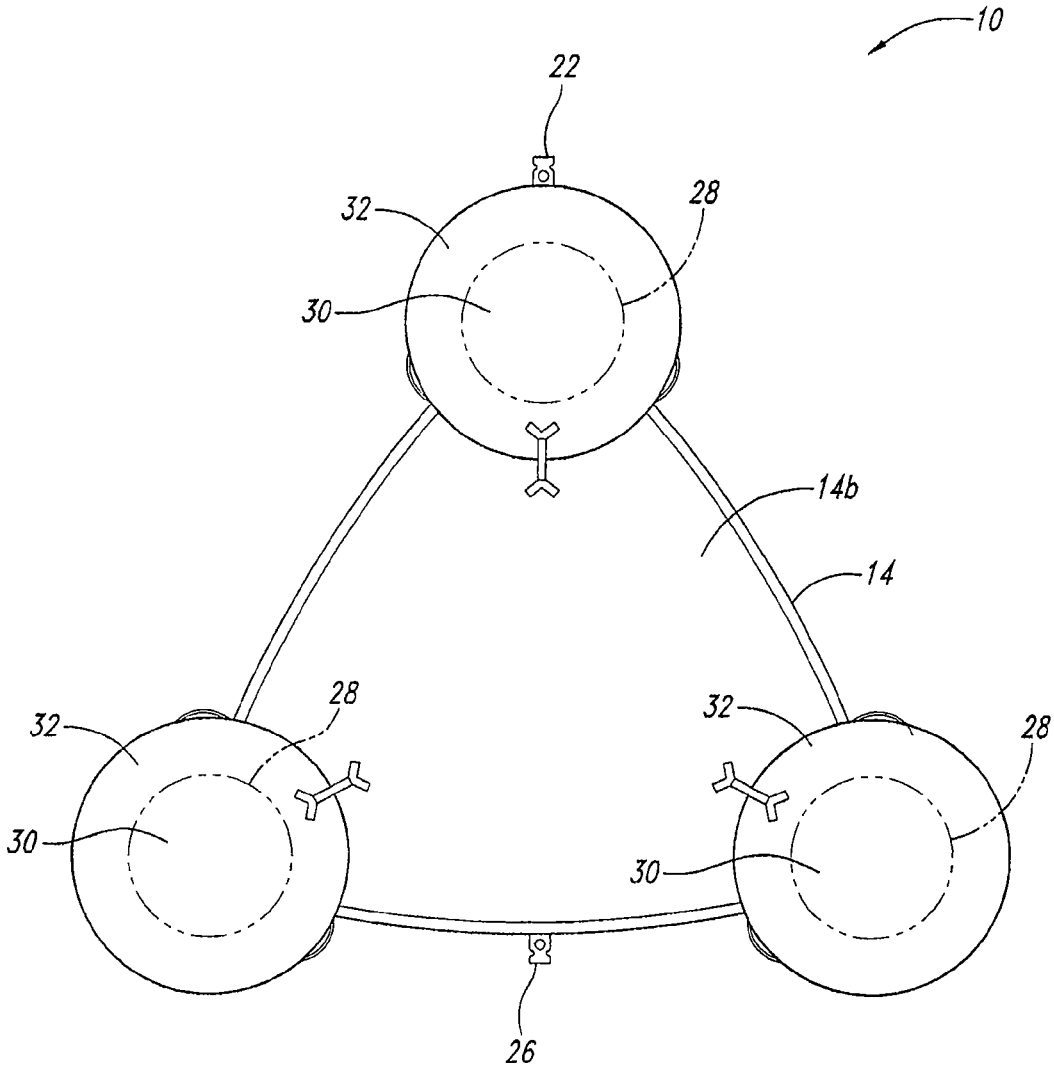
FIG. 4 is a bottom plan view of the first towable structure of the FIG. 1.

Although the base members 16 of the first towable structure 10 are depicted as approximating spheroids, other implementations have other shapes for the base members. For instance, the base members 16 could be shaped so that only those portions of the base members (know herein as the water contact portions of the base members) that are intended to be in contact with the body of water 12 during intended towing conditions (such as within gross weight ratings, towing speed limits, and acceptable wave conditions) would approximate portions of a spheroid or more generally portions of an ellipsoid or another curved body surface. More generally, a requirement in some implementations would only mandate that the submerged portion 30 (being depicted in FIGS. 3 and 4 as a cap portion of a spheroid) be a cap portion of some form of an ellipsoid or other curved body surface (an ellipsoid being a general class that includes but is not limited to spheroids). Other shapes for the base members 16 may also be used including shapes with one or more flat portions.

Some implementations use cylindrical cap portions, ellipsoid cap portions, or other shaped cap portions for either the water contact portions or at least the submerged portions 30 in which each of these cap portions are shaped such that any dimension passing through the centroid of a first area defined by the surface of the cap portion intersecting a first plane parallel to the plane of the water level 28 would be no more than 20% greater than any other dimension of the first area passing through the centroid of the first area. In these implementations the first towable structure 10 can skim over the water somewhat like a rudderless craft. For instance, if the tow boat turns sharply, the first towable structure 10 of these implementations is more likely to momentarily move in a direction other than the direction of the tow boat so that the base members 16 of the first towable structure would avoid digging into the water to such an extent as to cause the first towable structure to flip or otherwise assume an undesirable condition.

Figure 5:
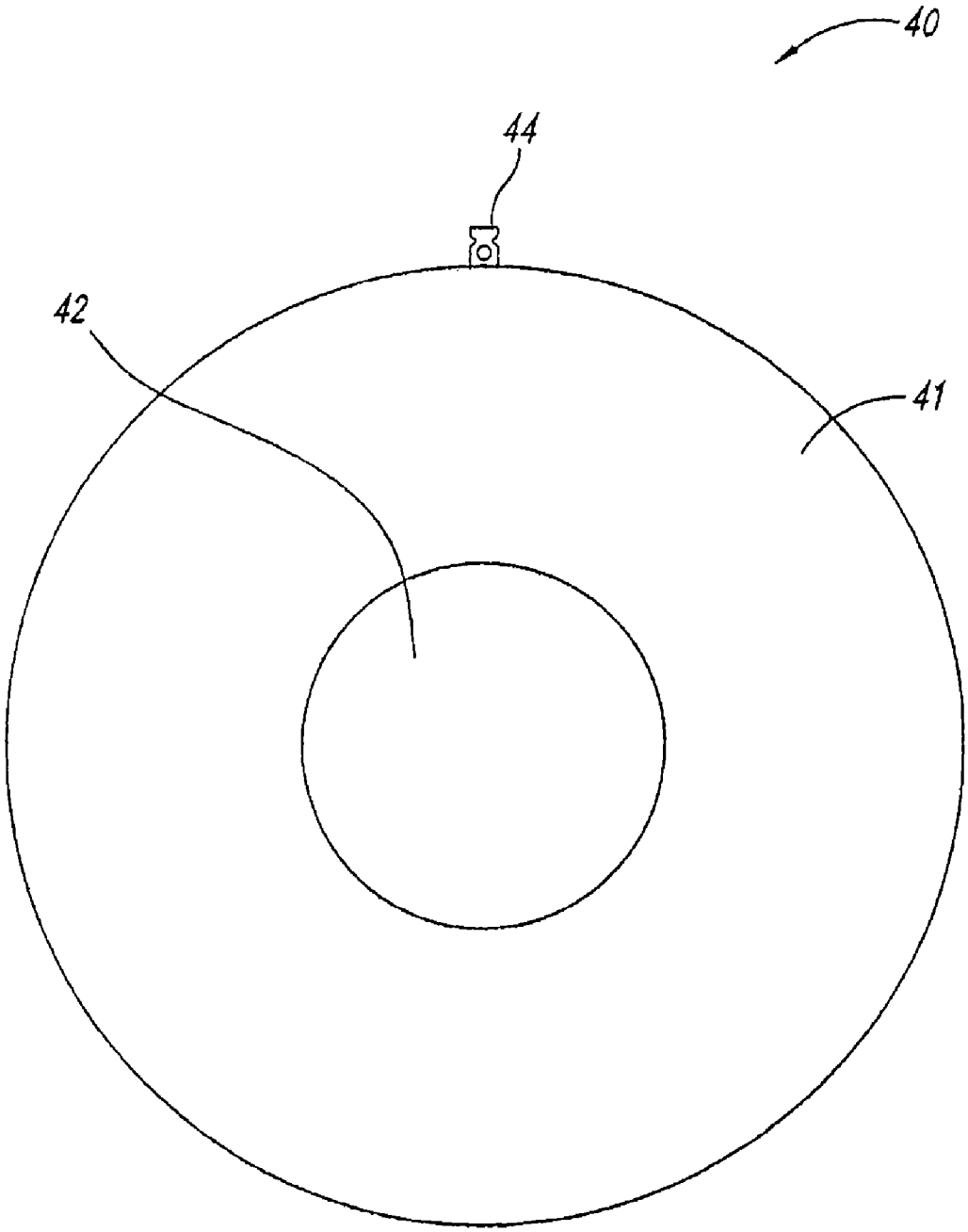
FIG. 5 is a top plan view of a second towable structure according to aspects of the present invention.
Figure 6:
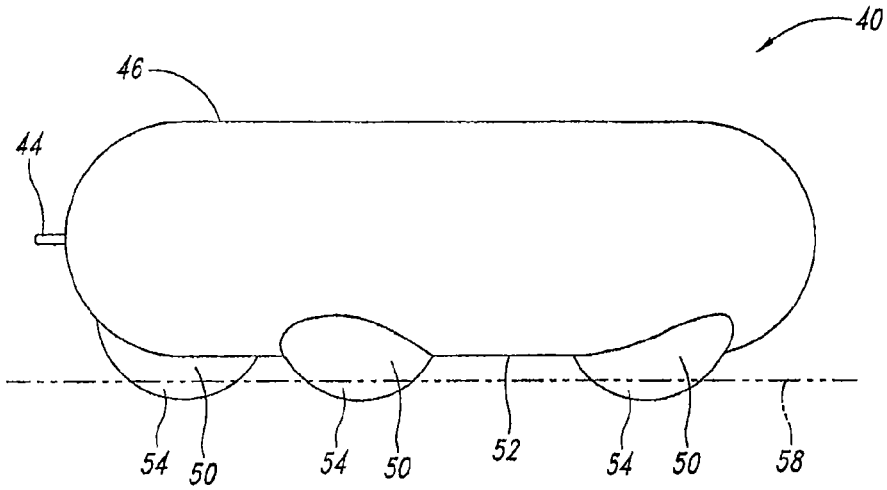
FIG. 6 is a side elevational plan view of the second towable structure of FIG. 5.
Figure 7:
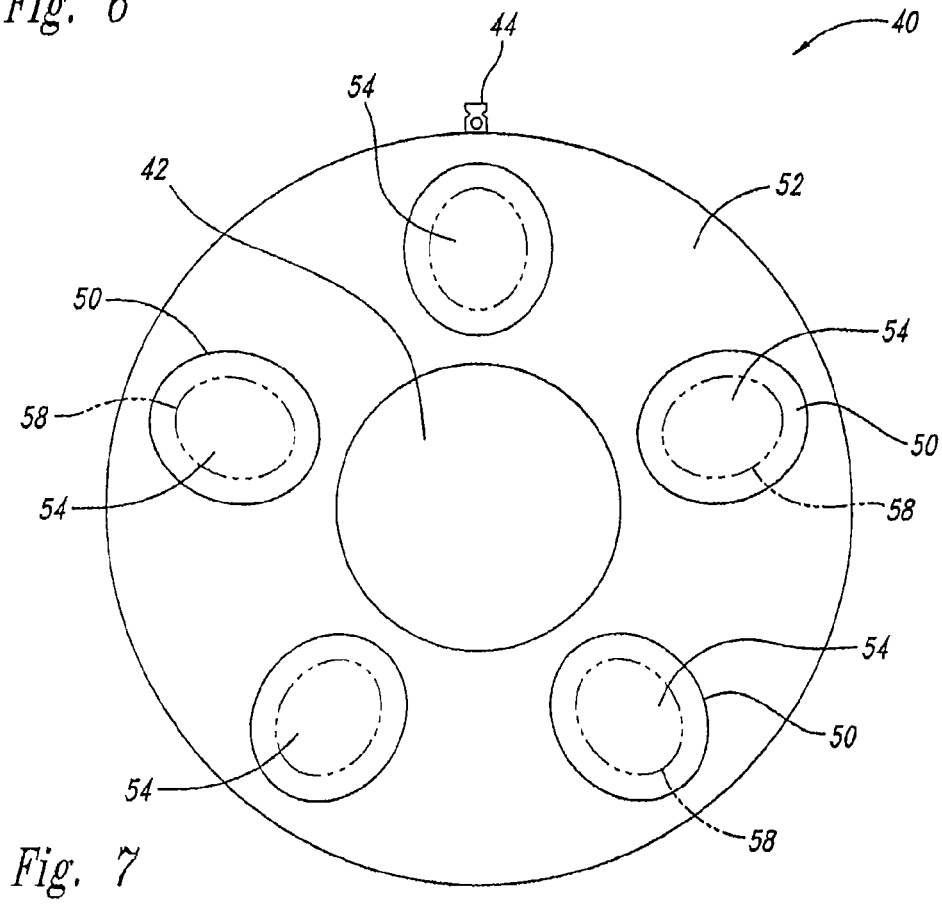
FIG. 7 is a bottom plan view of the second towable structure of FIG. 5.

A second towable structure 40 shown in FIG. 5 resembles a tire inner tube in shape having a ring like structure with an upper surface 41 surrounding a central opening 42 and having an attachment point 44 to couple to a flexible member (not shown) for towing. The upper surface 41 may be covered with a material cover spanning across the central opening 42 to define a support platform without a hole. The second towable structure 40 has five (better shown in FIG. 7) base members 50 that protrude from a lower surface 52 of the second towable structure 40 to raise the lower surface above the body of water 12. The second towable structure 40 is shown in FIG. 6 unloaded and sitting in the still body of water 12 with a level water surface 58. The submerged portions 54 of the base members 50 are ellipsoidal cap shaped as better shown in FIG. 7. In other implementations, the second towable structure 40 may have a different number of base members 50 and can be of other shapes similar to that described above concerning the submerged portions 30 of the base members 16 of the first towable structure 10.

Figure 8:
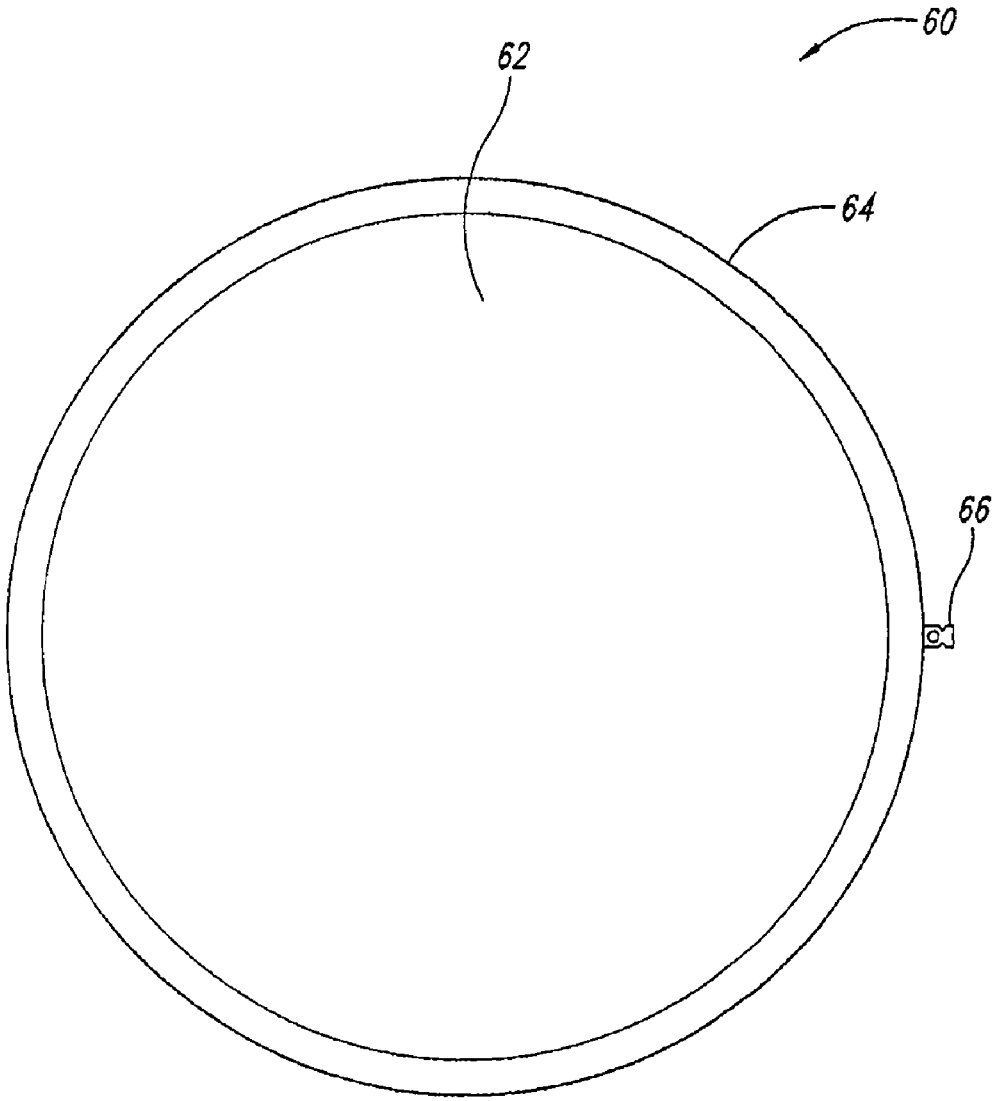
FIG. 8 is a top plan view of a third towable structure according to aspects of the present invention.
Figure 9:
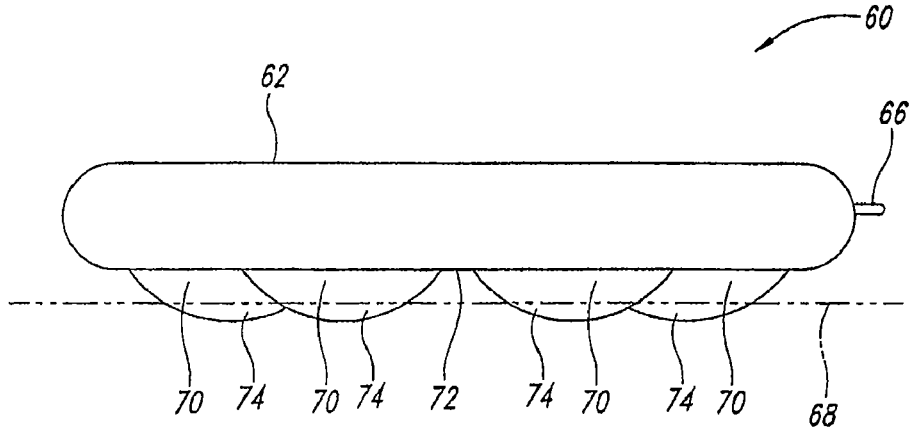
FIG. 9 is a side elevational plan view of the third towable structure of FIG. 8.
Figure 10:
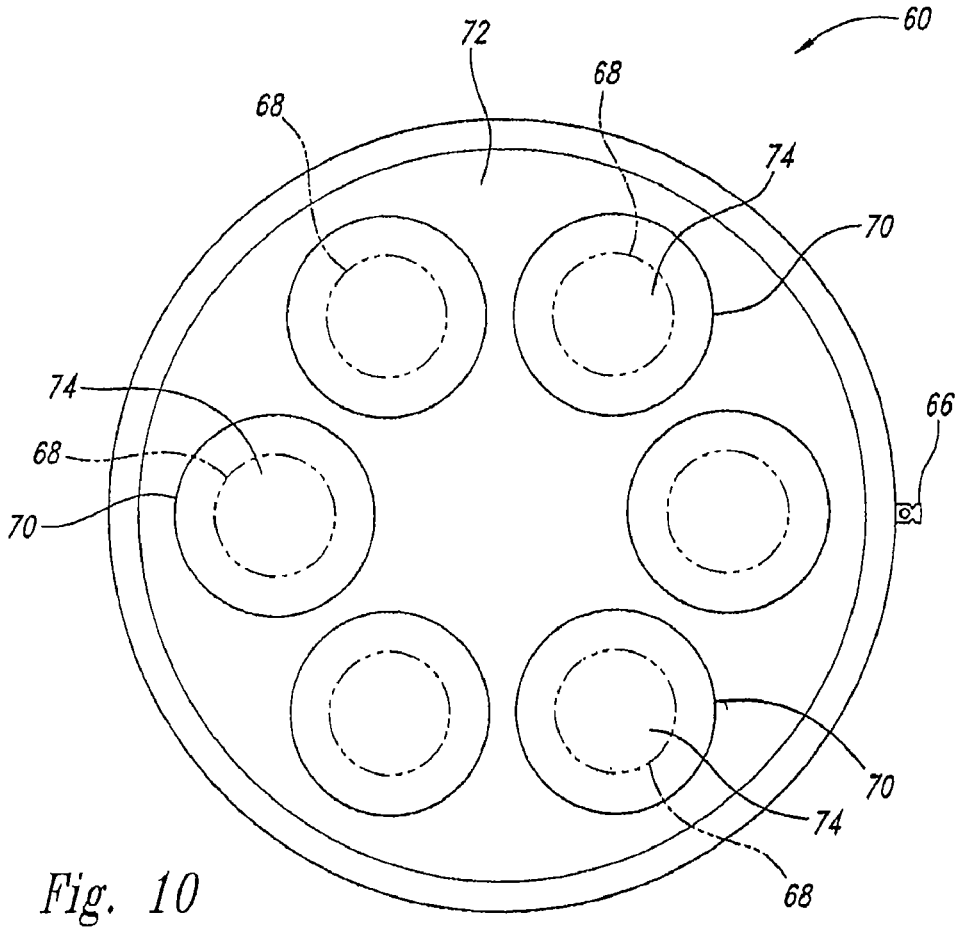
FIG. 10 is a bottom plan view of the third towable structure of FIG. 8.

A third towable structure 60 shown in FIG. 8 is disk shaped with a circular upper surface 62 having side wall 64 with an attachment point 66 for coupling to a flexible member (not shown) for towing. The third towable structure 60 further has six (better shown in FIG. 10) base members 70 extending from a lower surface 72 of the third towable structure as also shown in FIG. 9. A submerged portion 74 of each of the base members 70 extends below a level water surface 68 to elevate the lower surface 72 above the level water surface as shown in FIG. 9. As depicted, the base members 70 are shaped as portions of spheroids with the submerged portions 74 being spheroid caps as shown in FIGS. 9 and 10. In other implementations, the third towable structure 60 may have a different number of the base members 70 and can be of other shapes similar to that described above concerning the submerged portions 30 of the base members 16 of the first towable structure 10.

Figure 11:
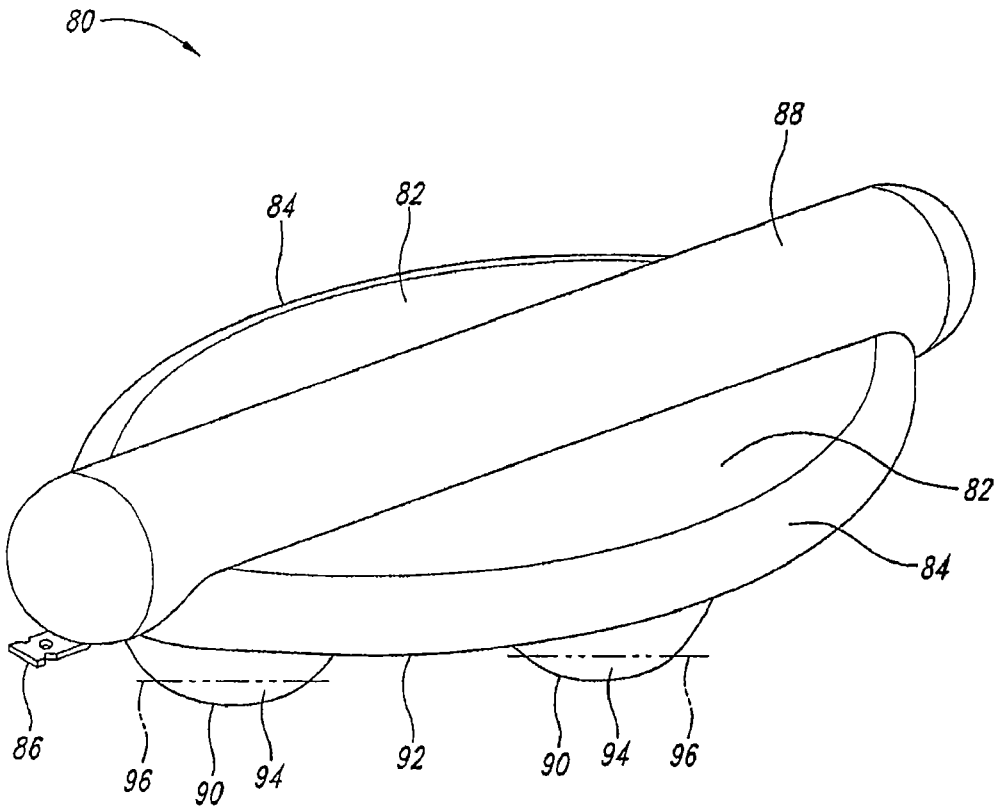
FIG. 11 is a top front isometric view of a fourth towable structure according to aspects of the present invention.
Figure 12:
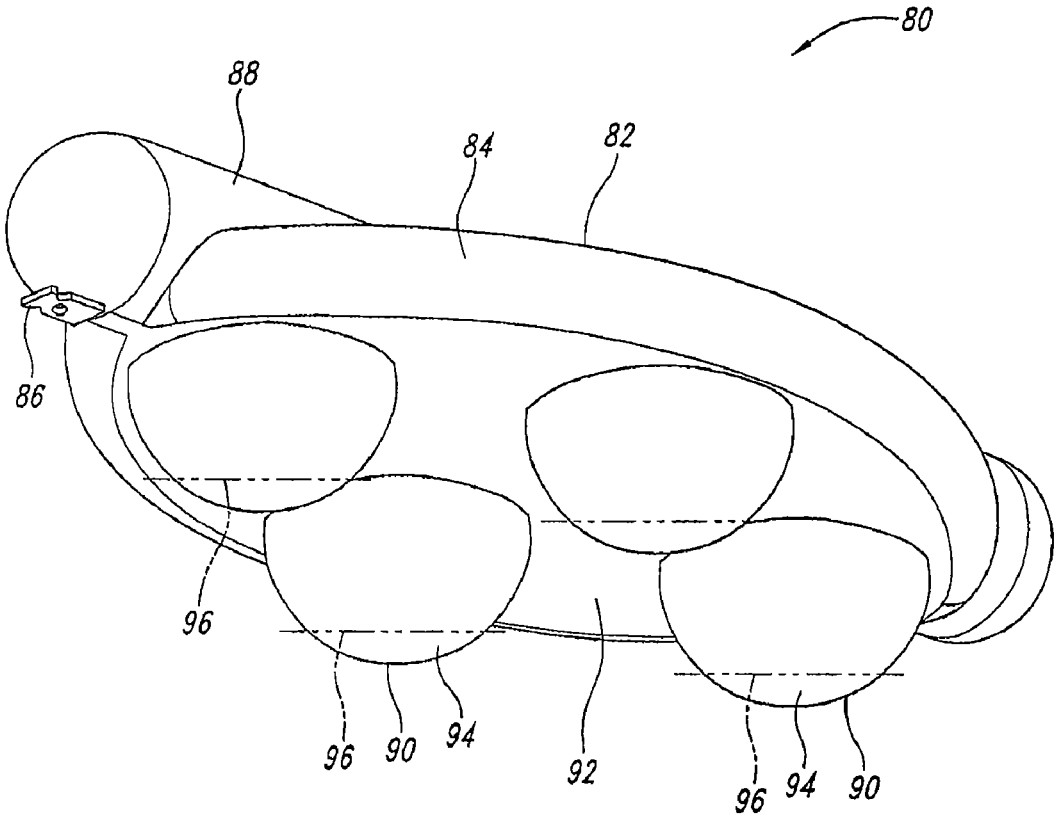
FIG. 12 is a bottom front isometric view of the fourth towable structure of FIG. 11.
Figure 13:
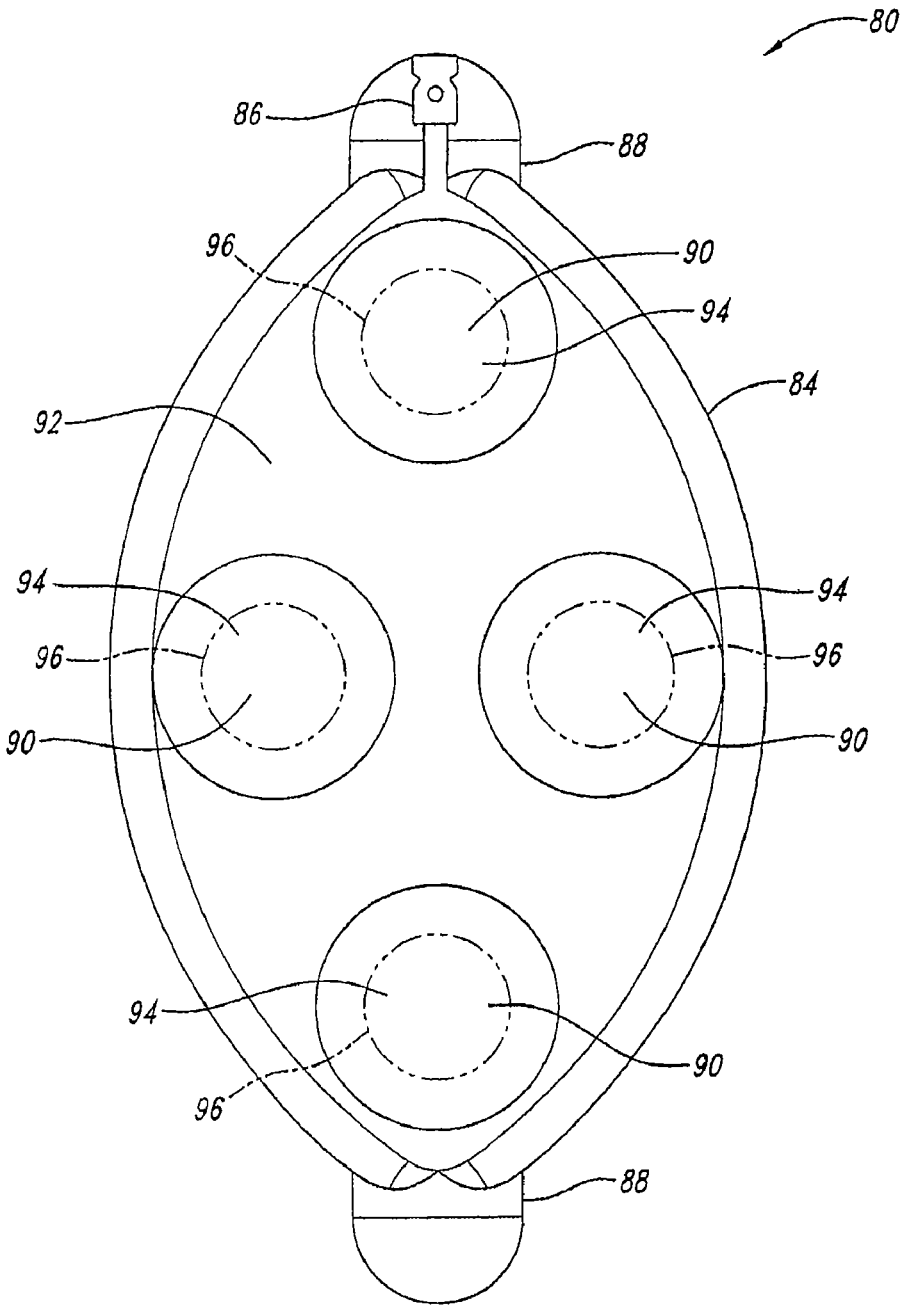
FIG. 13 is a bottom front view of the fourth towable structure at FIG. 11.

A fourth towable structure 80 shown in FIG. 11 has an elliptically shaped upper surface 82 having a side wall 84 with an attachment point 86 for coupling to a flexible member (not shown) for towing. An elongated cylindrically shaped member 88 protrudes above and extends longitudinally along the elongated dimension of the upper surface 82 to provide support to one or more passengers of the fourth towable structure 80. The fourth towable structure 80 further has four (better shown in FIG. 12) base members 90 extending from a lower surface 92 of the fourth towable structure. A submerged portion 94 of each of the base members 90 extends below a level water surface 96 to elevate the lower surface 92 above the level water surface as shown in FIGS. 11 and 12. As depicted, the base members 90 are shaped as portions of spheroids with the submerged portions 94 being spheroid caps as shown in FIGS. 11–13. In other implementations, the fourth towable structure 80 may have a different number of base members 90 and can be of other shapes similar to that described above concerning the submerged portions 30 of the base members 16 of the first towable structure 10.

Figure 14:
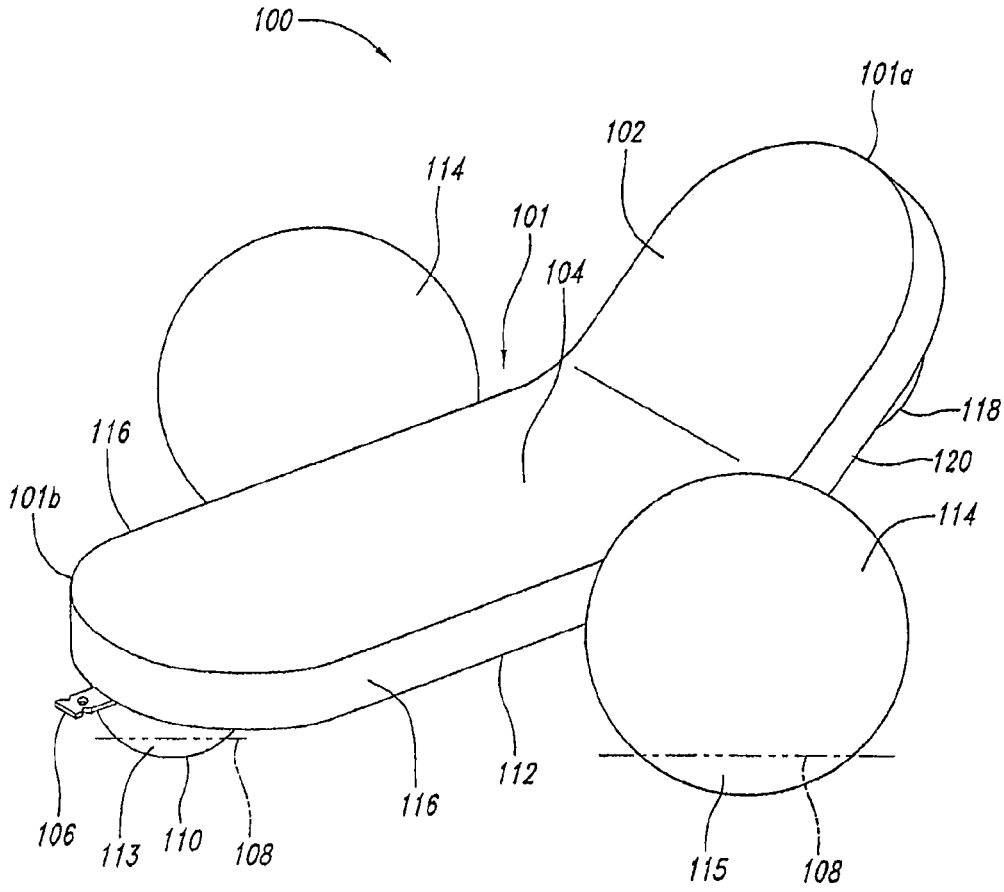
FIG. 14 is a top front isometric view of a fifth towable structure according to aspects of the present invention.
Figure 15:
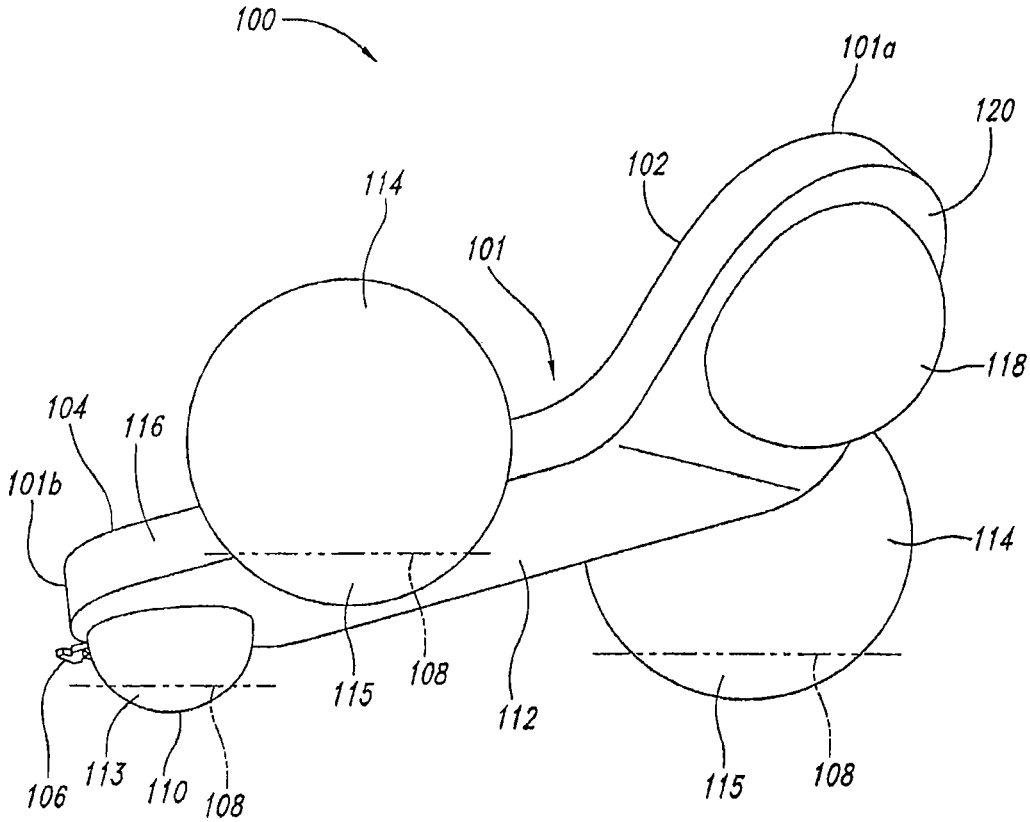
FIG. 15 is a bottom rear isometric view of the fifth towable structure of the FIG. 14.
Figure 16:
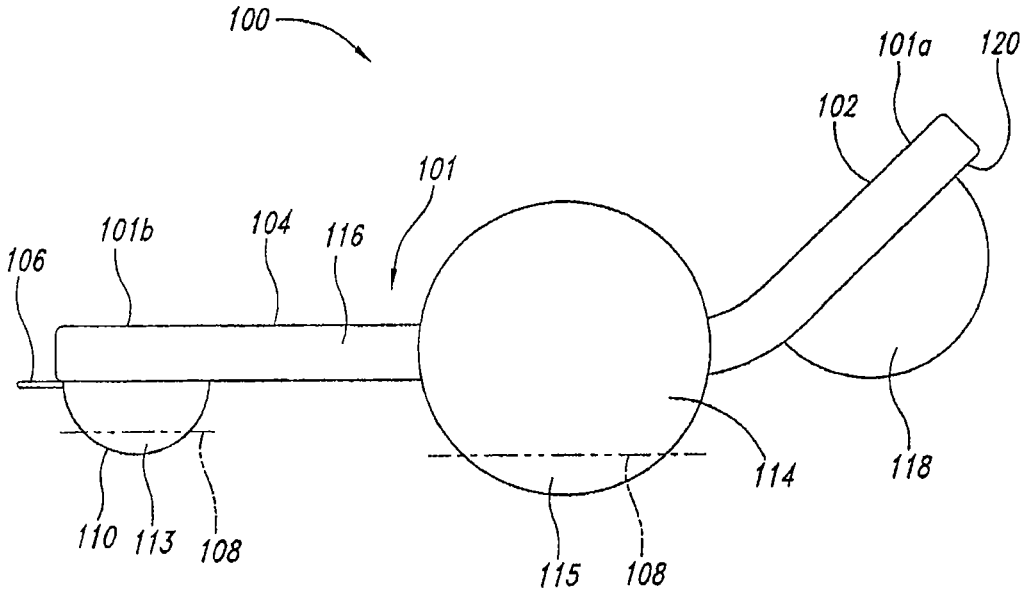
FIG. 16 is a side elevational plan view of the fifth towable structure of FIG. 14.

A fifth towable structure 100 shown in FIG. 14 has a lounge chair portion 101 having an upper torso portion 101*a* and a lower torso portion 101*b*. The upper torso portion 101*a* has a first upper surface portion 102 to support an upper torso portion of a passenger. The lower torso portion 101*b* has a second upper surface portion 104 to support a lower torso portion of the passenger. An attachment point 106 is coupled to the lower torso portion 101*b* of the lounge chair portion 101 to couple to a flexible member (not shown) for towing. As shown in FIGS. 14–16, the lounge chair portion 101 of the fifth towable structure 100 is supported above a level water surface 108 by a front base member 110 extending from a first lower surface 112 of the lower torso portion 101*b* and having a front submerged portion 113 below the level water surface and by two side base members 114 attached to two sides 116 of the lower torso portion 101*b* and having side submerged portions 115 below the level water surface.

As depicted, the front base member 110 is shaped as a spheroid cap whereas the side base members 114 are shaped as full spheroids. Consequently, the front submerged portion 113 and the side submerged portions 115 are shaped as spheroid caps. The fifth towable structure 100 also has a rear base member 118 extending from a second lower surface 120 of the upper torso portion 101*a* to support the upper torso portion of the lounge chair portion 101 above the level water surface when the weight distribution of a load supported by the lounge chair portion is such that the lounge chair portion tips rearward sufficiently so that the second lower surface 120 is moved toward the water surface. In other implementations of the fifth towable structure 100, the front submerged portion 113 and the side submerged portions 115 can be of other shapes similar to that described above concerning the submerged portions 30 of the base members 16 of the first towable structure 10.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A structure to be towed in a body of water, the structure comprising:

an air inflatable, non-rigid first bladder having an upper surface and a lower surface spaced apart from the upper surface with an air-filled space therebetween, with the upper surface forming a platform sized to flexibly support at least one rider thereon;

at least three spaced apart buoyant air inflatable, non-rigid second bladders;

a flexible shell, the shell having the first bladder and the second bladders positioned and securely retain therein during towing of the structure without use of rigid support frame members, the first bladder being non-rigidly retained relative to the second bladders, the second bladders extending from the location of the first member bladder downward and having sufficient buoyancy such that when the second bladders are placed in the body of water, the first bladder remains elevated above the body of water to define an air space between the lower surface of the first bladder and the body of water when the body of water has a level water surface; and a tow line attachment attached to the shell.

2. The structure of claim 1 wherein the first bladder has a perimeter portion and a mid-portion bounded by the perimeter portion sized to flexibly support the at least one rider thereon, the second bladder being positioned at and extending downward from the perimeter portion of the first bladder to define an area below the mid-portion of the first bladder above the body of water.

3. The structure of claim 1 wherein the first bladder has a perimeter portion defining a first area portion bounded by the perimeter portion sized to flexibly support the at east one rider thereon, the second bladders being positioned at and extending downward from the perimeter portion of the first bladder to define a second area below the first area above the body of water.

4. The structure of claim 1 wherein the second bladders have a size and buoyancy to position the lower surface of the first bladder a distance of at least 2 inches above the level water surface.

5. The structure of claim 1 wherein the second bladders each have a water contacting surface contacting the body of water when the body of water has a level water surface and the total surface area of the water contacting surface of the second members is no more than 50% of the surface area of the upper surface of the first bladder.

6. The structure of claim 1 wherein the second bladders each have a submerged arcuate portion that contacts the body of water.

7. The structure of claim 1 wherein the first bladder has at least three sides defining at least three corner portions, the second bladders each being coupled to different ones of the corner portions of the first bladder.

8. The structure of claim 7 wherein the second bladders each are substantially circular in cross-section in a region at which the first bladder is coupled to the second bladder and the corner portions of the first bladder extend along at least a 25% lengthwise portion of each of the second bladders in the substantially circular region thereof.

9. The structure of claim 1 wherein a portion of the second bladders contacting the body of water has a curved surface.

10. The structure of claim 9 wherein the portion of the second bladders that contacts the body of water has a surface of spheroidal caps.

11. The structure of claim 1 wherein at least one of the second bladders extends from the first bladder directly toward the body of water when the second bladder is contacting the body of water.

12. The structure of claim 1 wherein the first bladder has side surfaces extending between the lower surface and the upper surface and wherein the second bladders are each positioned at and extend downward from one of the side surfaces.

13. A water sport play structure to be towed in a body of water while supporting a passenger, the structure comprising:

a non-rigid platform member having an upper surface forming a platform sized to flexibly support at east one rider thereon;

at least three spaced apart buoyant air inflatable, non-rigid support members; and a fabric shell having the platform member and the support members positioned and secure retain therein during towing of the structure without use of rigid support frame members, the fabric shell non-rigidly retaining the platform member relative to the support members, the support members extending downward from adjacent the platform member and having sufficient buoyancy such that when the support members are placed in the body of water, the platform member remains elevated above the body of water while supporting the passenger to define an air space between a lower surface of the platform member and the body of water when the body of water has a level water surface, wherein the support members each comprise an inflatable buoyant bladder coupled to the platform member by the portion of at least one fabric shell, the buoyant bladders being positioned within the at least one portion of the fabric shell.

14. A water sport play structure to be towed in a body of water, the structure comprising:

an air inflatable, non-rigid first member having an upper surface and a lower surface; and at least three spaced apart buoyant air inflatable, non-rigid second members non-rigidly attached to the first member with the second members extending from the first member and having sufficient buoyancy such that when the second members are placed in the body of water, the first member remains elevated above the body of water when the body of water has a level water surface, the second members each having a water contacting surface contacting the body of water when the body of water has a level water surface, the total surface area of the water contacting surface of the second members being no more than 40% of the surface area of the upper surface of the first member, wherein portions of the first and second members are positioned in a shell.

15. A water sport play structure to be towed in a body of water, the structure comprising:

an air inflatable, non-rigid first member having an upper surface and a lower surface spaced apart from the upper surface with an air-filled space therebetween; and at least three spaced apart buoyant air inflatable, non-rigid second members non-rigidly attached to the first member with the second members extending from the first member and having sufficient buoyancy such that when the second members are placed in the body of water, the first member remains elevated above the body of water when the body of water has a level water surface, the second members each having a submerged arcuate portion that contacts the body of water, wherein portions of the first and second members are positioned in a shell.

16. A structure to be towed in a body of water, the structure comprising:

an air inflatable, non-rigid platform bladder having an upper surface and a lower surface spaced apart from the upper surface with an air-filled space therebetween, the platform bladder having at least three sides defining at least three corners;

at least three spaced apart buoyant air inflatable, non-rigid support bladders;

a fabric shell securely retaining the platform bladder and the support bladders therein during towing of the structure with each of the support bladders non-rigidly retained at a different one of the corners of the platform bladder and extending downward therefrom, the support bladders having sufficient buoyancy such that when the support bladders as inflated are placed in the body of water, the platform bladder remains elevated above the body of water to define an air space between the lower surface of the platform bladder and the body of water when the body of water has a level water surface.

* * * * *